US009803516B2

(12) United States Patent
Byrd et al.

(10) Patent No.: US 9,803,516 B2
(45) Date of Patent: Oct. 31, 2017

(54) SYSTEM AND METHOD FOR PREVENTING ROTATION OF VALVE LIFTER

(71) Applicant: Caterpillar Inc., Peoria, IL (US)

(72) Inventors: Jeremy D. Byrd, West Lafayette, IN (US); Kevin W. Redinbo, Delphi, IN (US); Bryce L. Tiller, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 63 days.

(21) Appl. No.: 15/060,623

(22) Filed: Mar. 4, 2016

(65) Prior Publication Data

US 2017/0254231 A1 Sep. 7, 2017

(51) Int. Cl.
*F01L 1/14* (2006.01)

(52) U.S. Cl.
CPC ..... *F01L 1/146* (2013.01); *F01L 1/14* (2013.01); *F01L 2107/00* (2013.01)

(58) Field of Classification Search
CPC ..... F01L 1/14; F01L 1/146; F01L 2107/00
USPC ..... 123/90.38, 90.48, 90.5, 90.54
See application file for complete search history.

(56) References Cited

U.S. PATENT DOCUMENTS

| | | | | |
|---|---|---|---|---|
| 5,088,455 | A | 2/1992 | Moretz | |
| 6,405,699 | B1 | 6/2002 | Church | |
| 6,691,658 | B2 | 2/2004 | Fujita et al. | |
| 7,086,360 | B1 | 8/2006 | Schnell et al. | |
| 7,121,244 | B2 | 10/2006 | Roe et al. | |
| 7,373,907 | B2 | 5/2008 | Balaraman et al. | |
| 7,409,940 | B2 | 8/2008 | Riley | |
| 8,136,494 | B2 | 3/2012 | Atzwanger et al. | |
| 8,342,145 | B2 * | 1/2013 | Klotz | F01L 1/14 123/90.48 |
| 8,826,874 | B2 | 9/2014 | Hattiangadi et al. | |

* cited by examiner

*Primary Examiner* — Ching Chang

(57) ABSTRACT

An internal combustion engine having a valve lifter assembly is disclosed. The internal combustion engine comprising an engine head having at least two wells adapted to receive at least one valve lifter, the at least one valve lifter includes a flat surface, at least one spacer installed within the engine head having a first surface, a hollow portion, and a second surface, the first surface is tapered with respect to a vertical axis of the at least one spacer, and a tie-bar plate for coupling the at least one spacer using head bolts. The at least one spacer and the at least one valve lifter are operatively arranged during operation in such a way that the flat surface of the at least one valve lifter faces the first surface of the at least one spacer to prevent rotation of the at least one valve lifter.

1 Claim, 5 Drawing Sheets

SYSTEM AND METHOD FOR PREVENTING ROTATION OF VALVE LIFTER

TECHNICAL FIELD

The present disclosure relates to valve lifters for internal combustion engines, and more specifically, to a system and method for preventing rotation of the valve lifters using redesigned lifters and spacers.

BACKGROUND

Internal combustion engines employ valve lifters (also called lifters) that slide reciprocally within a bore. The lifters use a lift roller at its lower end for engaging a camshaft lobe via a camshaft follower. The lift roller reduces friction during the reciprocation, provides extended camshaft life, improves efficiency and improves life of the valve lifters, etc.

During engine operation, there are chances of unwanted rotation of the valve lifters with respect to its vertical axis. Such rotational mechanism of the valve lifters causes excessive wear on the camshaft and also on the lift rollers.

U.S. Pat. No. 6,405,699, hereinafter referred to as '699 reference, discloses a roller follower guide orientation and anti-rotation feature. The reference '699 discloses a valve actuation sub-assembly for an internal combustion engine. The valve actuation sub-assembly is adapted to be attached to an engine block. The valve actuation sub-assembly includes a conventional roller follower and a deactivating roller follower. The valve actuation sub-assembly includes a follower guide member defining a first guide receptacle for receiving an upper portion of the conventional roller follower, and a second guide receptacle for receiving an upper portion of the deactivating roller follower. The 699 reference prevents assembly errors as neither upper portion is received within the guide receptacle intended for the other upper portion. The one roller follower type is installed in a location on the engine intended for the other roller follower type. However, the '699 reference fails to prevent rotation of the valve lifters within the bore. Conventional techniques are unable to prevent the rotation of the valve lifters within the bore during reciprocating movement. Therefore, there is a need for a system and method for preventing rotation of the valve lifters during reciprocating movement.

SUMMARY OF THE DISCLOSURE

In one aspect of the present disclosure, an internal combustion engine having a valve lifter assembly is disclosed. The internal combustion engine comprising an engine head having at least two wells, each of the at least two wells are adapted to receive at least one valve lifter, the at least one valve lifter includes a flat surface, at least one spacer installed within the engine head, the at least one spacer having a first surface, a hollow portion, and a second surface, wherein the first surface is tapered with respect to a vertical axis of the at least one spacer, and a tie-bar plate for coupling the at least one spacer using head bolts, when the at least one spacer is installed at a desired position within the engine head. The at least one spacer and the at least one valve lifter are operatively arranged during operation in such a way that the flat surface of the at least one valve lifter faces the first surface of the at least one spacer to prevent rotation of the at least one valve lifter.

Other features and aspects of this disclosure will be apparent from the following description and the accompanying drawings.

DETAILED DESCRIPTION

Figure 1:
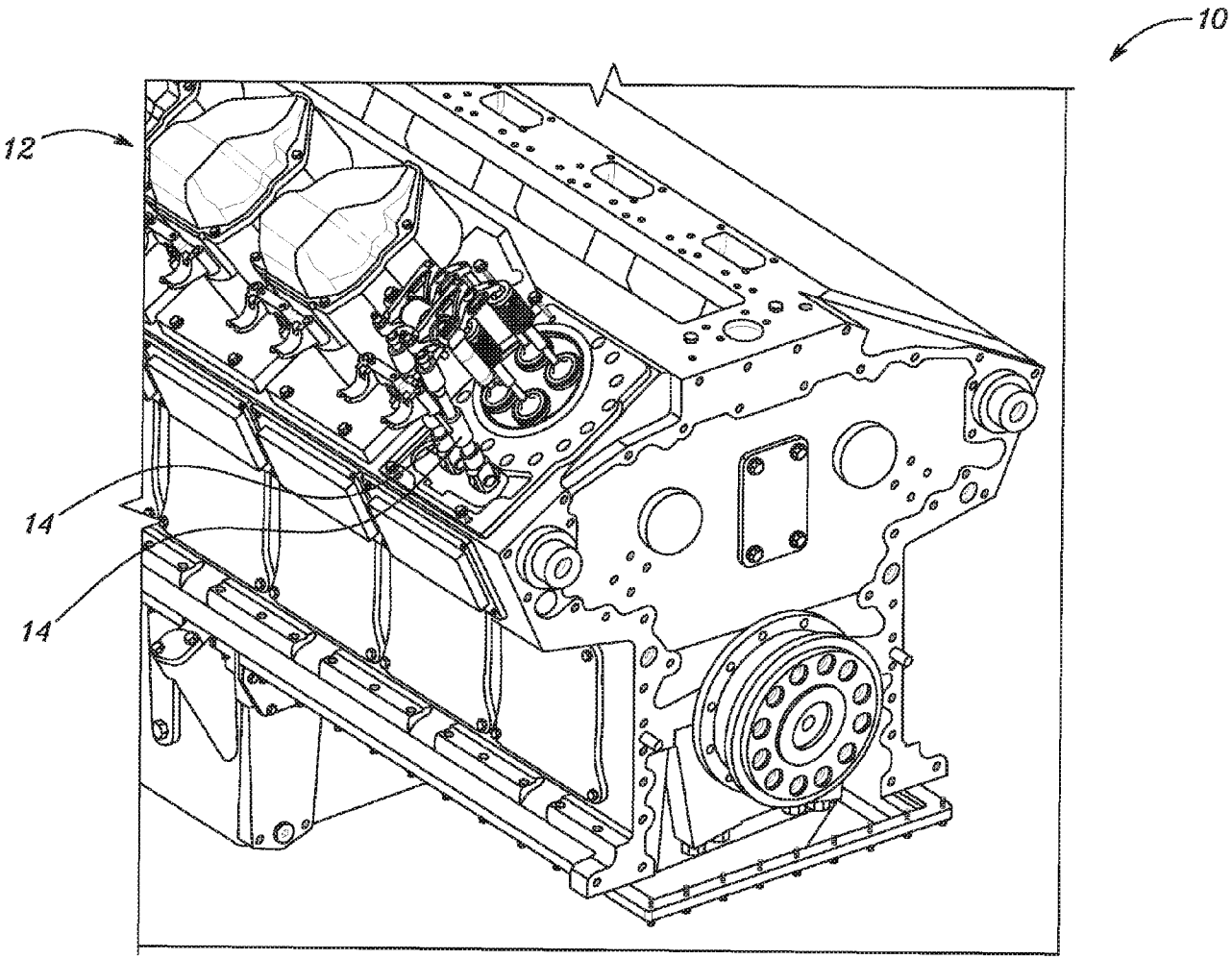
FIG. 1 shows an engine having a valve lifter within an engine head, in accordance with the concepts of the present disclosure.

Referring to FIG. 1, an engine 10 having an engine head 12. The engine head 12 employs a valve lifter assembly (not labeled in FIG. 1) having a number of valve lifters 14. For the purposes of the present disclosure, the engine 10 is an internal combustion engine. The terms "engine 10" and "internal combustion engine 10" have similar meaning and interpretations and may be interchangeably used with the description without departing from the meaning and scope of the disclosure. It will be apparent to one skilled in the art that the engine 10 may be any type of internal combustion engine such as, for example, diesel, a gasoline or natural gas engine, etc. During operations, a rotary motion of a cam lobe (not shown) is translated into a reciprocal movement of the valve lifters 14. For the purpose of simplicity, the various components of the engine 10 are not labeled in FIG. 1.

Figure 2:
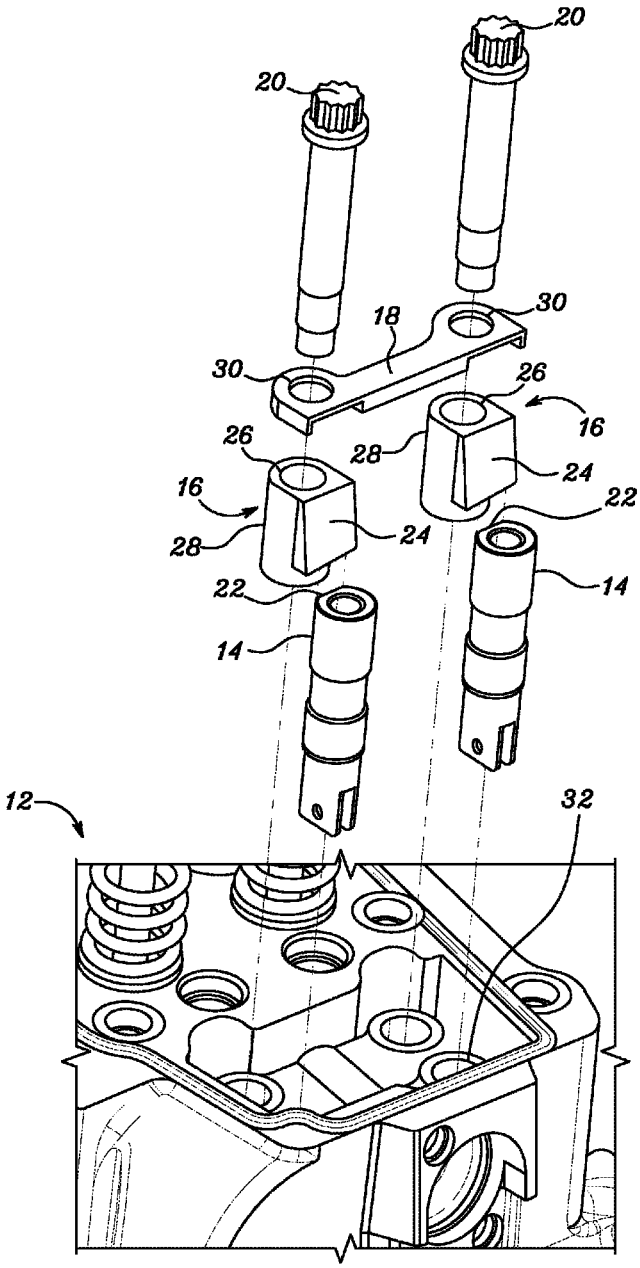
FIG. 2 shows an exploded view of the valve lifter, a spacer and a tie-bar plate installed within the engine head, in accordance with the concepts of the present disclosure.

Referring to FIG. 2, a number of valve lifters 14 (hereinafter the valve lifter 14), a number of spacers 16 (hereinafter a spacer 16) and a tie-bar plate 18 are installed within the engine head 12. In an embodiment, the valve lifter 14 has a flat surface 22. It will be apparent to one skilled in the art that the valve lifters 14 may have other shapes or design without departing from the meaning and scope of the disclosure. The spacer 16 is redesigned to have a first surface 24 that is tapered. The spacer 16 has the first surface 24 (i.e. tapered surface), a hollow portion 26, and a second surface 28. In an embodiment, the first surface 24 of the spacer 16 is tapered with respect to a vertical axis of the spacer 16. The hollow portion 26 is used for receiving a head bolt 20 for coupling two spacers, i.e. the spacers 16 at a desired position within the engine head 12. For illustration purposes, the two spacers 16 are coupled together with the tie-bar plate 18 using the head bolts 20. In an embodiment, the desired position defines a position that ensures accurate orientation and position of the spacers 16 within the engine head 12 (as described in FIG. 3). It will be apparent to one skilled in the art that the spacer 16 may have any other design, shape, that prevents rotation of the valve lifter 14 without departing from the meaning and scope of the disclosure.

Referring to FIG. 2, the tie-bar plate 18 having holes 30 on each end. The holes 30 are used for receiving the head bolts 20 for coupling the tie-bar plate 18 over the spacers 16, while the spacers 16 are at the desired position within the engine head 12. In an embodiment, the tie-bar plate 18 couples the spacers 16 by receiving the head bolts 20 through the holes 30 and the hollow portion 26. It will be apparent to one skilled in the art that the tie-bar plate 18 may be a separate component or may be integrated with the spacers 16 as a single component without departing from the meaning and scope of the disclosure. During coupling, the holes 30 overlap with the hollow portion 26 of the spacers 16 to receive the head bolts 20. The head bolts 20 passes through the holes 30 of the tie-bar plate 18 and the hollow portion 26 of the spacers 16 for positioning the spacers 16 within the engine head 12. It will be apparent to one skilled in the art that other coupling mechanisms other than the head bolts 20 may be used without departing from the meaning and scope of the disclosure.

Referring to FIG. 2, the engine head 12 having a number of wells 32 (hereinafter the wells 32). The wells 32 (only one well is visible in FIG. 2) are adapted to receive the valve lifters 14. During operations, the valve lifters 14 reciprocate within the wells 32 of the engine head 12. The spacers 16 and the valve lifters 14 are operatively arranged during operation in such a way that the flat surface 22 of the valve lifter 14 faces the first surface 24 (i.e. tapered surface) of the spacers 16 to prevent rotation of the valve lifters 14. In an embodiment, the first surface 24 of the spacer 16 is parallel to the flat surface 22 of the valve lifter 14. The subsequent paragraphs describe installation procedures of the spacers 16, the tie-bar plate 18 and the valve lifters 14 within the engine head 12.

Figure 3:
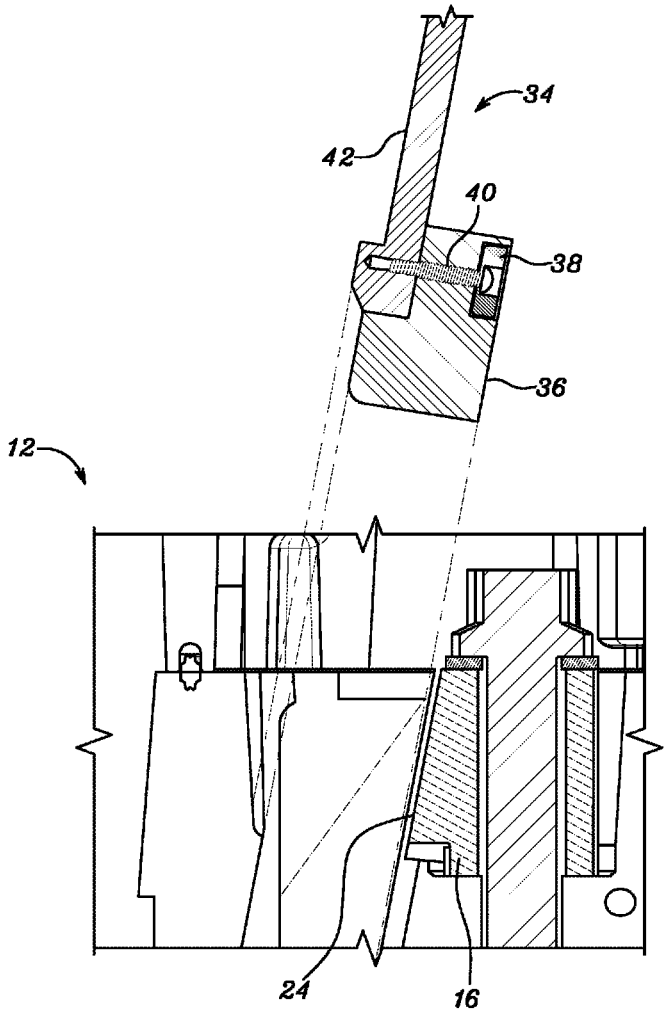
FIG. 3 shows a side sectional view of the engine head with an installation module to be assembled (i.e. positioned) or removed within the engine head for facilitating the installation of the spacer, in accordance with the concepts of the present disclosure.

Referring to FIG. 3, an installation module 34 is assembled (i.e. positioned) or removed within the engine head 12 for facilitating accurate installation of the spacer 16. The installation module 34 includes a lower member 36 and an upper member 42. The lower member 36 is integrally coupled with the upper member 42 via a screw 40 holding a magnet 38.

Further as illustrated in FIG. 3, the lower member 36 of the installation module 34 touches the first surface 24 (i.e. tapered surface) of the spacer 16 to ensure accurate orientation of the spacer 16 within the engine head 12. It will be apparent to one skilled in the art that the spacer 16, the valve lifter 14 and the tie-bar plate 18 may be constructed from hardened steel or any other suitable materials without departing from the meaning and scope of the disclosure.

Figure 4:
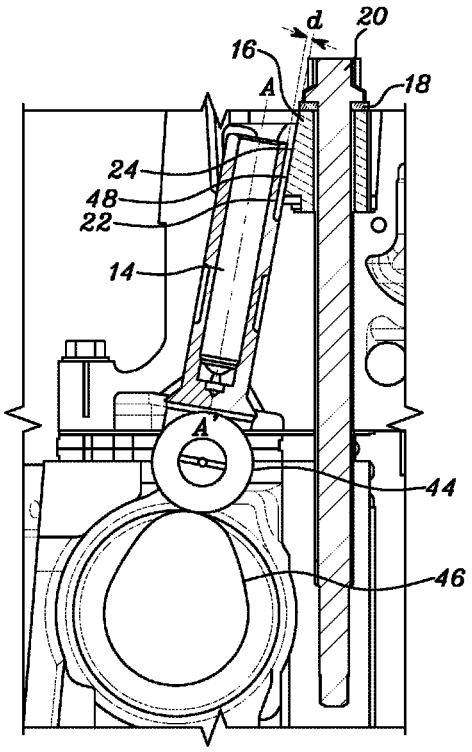
FIG. 4 shows a side sectional view of the valve lifter over a cam lobe during reciprocating movement, in accordance with the concepts of the present disclosure.

Referring to FIG. 4, the valve lifter 14 is coupled over a cam lobe 46 (also called camshaft lobe 46) via a roller 44 to perform reciprocating movement. The flat surface 22 of the valve lifter 14 and the first surface 24 (i.e. tapered surface) of the spacer 16 face towards each other and are in close proximity and parallel with a gap 48. The flat surface 22 of the valve lifter 14 and the first surface 24 (i.e. the tapered surface) of the spacer 16 are spaced apart from each other by a predetermined distance 'd'. Such operational arrangement prevents any undesired rotational movement of the valve lifter 14 with respect to an axis A-A'. In an embodiment, the predetermined distance 'd' between the flat surface 22 of the valve lifter 14 and the first surface 24 of the spacer 16 is 0.3 mm. It will be apparent to the one skilled in the art that the predetermined distance 'd' may be varied without departing from the meaning and scope of the present disclosure.

INDUSTRIAL APPLICABILITY

Figure 5:
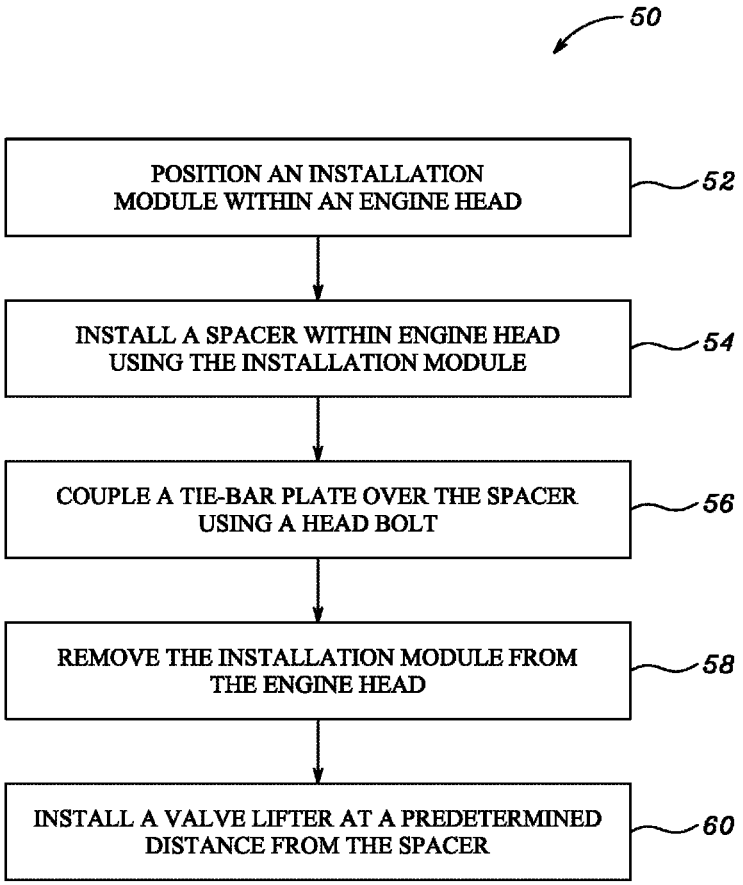
FIG. 5 shows a flow diagram of a method for installing the spacer and the valve lifter in the engine head, in accordance with the concepts of the present disclosure.

Referring to FIG. 5, a flow diagram of a method 50 for installing the spacer 16 and the valve lifter 14 is disclosed. The method 50 is described in conjunction with the FIGS. 1-4.

At step 52, the installation module 34 is temporarily positioned within the engine head 12. The installation module 34 ensures accurate orientation and position (i.e. desired position) of the spacer 16 within the engine head 12.

At step 54, the spacer 16 is installed within the engine head 12. The spacer 16 is accurately positioned within the engine head 12 using the installation module 34.

At step 56, the tie-bar plate 18 is coupled over the spacers 16 (i.e. two spacers 16) using the head bolts 20, while the spacers 16 are at the desired position.

At step 58, the installation module 34 is removed from the engine head 12.

At step 60, the valve lifter 14 is installed into the well 32 of the engine head 12 at the predetermined distance 'd' from the spacer 16. The spacer 16 and the valve lifter 14 are operatively arranged during operation in such a way that the flat surface 22 of the valve lifter 14 faces and is parallel to the first surface 24 (i.e. the tapered surface) of the spacer 16 to prevent rotation of the valve lifter 14.

The spacer 16 and the valve lifter 14 are designed and mechanically arranged in such a manner that prevents undesired rotation of the valve lifter 14 without the need for any additional devices, such as link bars, clips, etc. Instead, the valve lifter 14 includes integral structure, i.e. the flat surface 22 that is in close proximity with the spacer 16 for preventing the rotation of the valve lifter 14.

The present disclosure provides easy to implement mechanism for preventing rotation of the valve lifter 14 during its reciprocating movement. Also, the spacer 16 and the valve lifter 14 are cost effective and hence help in reducing maintenance costs, or risk failure costs that incur due to misalignment of components due to the rotation of the valve lifter 14. Further, the spacer 16, and the tie-bar plate 18 are easy to manufacture owing to the flat tapered shape.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An internal combustion engine having a valve lifter assembly, the internal combustion engine comprising:

an engine head having at least two wells, each of the at least two wells are adapted to receive at least one valve lifter, the at least one valve lifter includes a flat surface;

at least one spacer installed within the engine head, the at least one spacer having a first surface, a hollow portion, and a second surface, wherein the first surface is tapered with respect to a vertical axis of the at least one spacer; and a tie-bar plate for coupling the at least one spacer using head bolts, when the at least one spacer is installed at a desired position within the engine head;

wherein the at least one spacer and the at least one valve lifter are operatively arranged during operation in such a way that the flat surface of the at least one valve lifter faces the first surface of the at least one spacer to prevent rotation of the at least one valve lifter.

* * * * *